US006065683A

United States Patent [19]

Akin et al.

[11] Patent Number: 6,065,683

[45] **Date of Patent: *May 23, 2000**

[54] METHOD AND APPARATUS FOR CONDITIONING FLUID FLOW

[75] Inventors: John E. Akin; Stephen K. Smith; N. Roland Dove, all of Houston, Tex.

[73] Assignee: Vortexx Group, Inc., Houston, Tex.

[ * ] Notice: This patent is subject to a terminal disclaimer.

[21] Appl. No.: 09/261,901

[22] Filed: Mar. 3, 1999

Related U.S. Application Data

[63] Continuation of application No. 08/825,124, Mar. 27, 1997, Pat. No. 5,921,476, which is a continuation of application No. 08/357,511, Dec. 16, 1994, Pat. No. 5,785,258, which is a continuation-in-part of application No. 08/134,085, Oct. 8, 1993, Pat. No. 5,494,124.

[51] Int. Cl.[7] ..... F02D 7/00

[52] U.S. Cl. ..... 239/5; 239/590; 239/599; 239/601; 175/424

[58] Field of Search ..... 239/589, 5, 590, 239/590.5, 597, 598, 599, 601; 175/424; 37/317, 323; 111/118, 127; 405/269, 248

[56] References Cited

U.S. PATENT DOCUMENTS

| | | | |
|---|---|---|---|
| 705,530 | 7/1902 | Higgins | 239/593 |
| 1,756,965 | 5/1930 | Zademach . | |
| 2,724,583 | 11/1955 | Targosh et al. | 239/593 |
| 2,901,223 | 8/1959 | Scott . | |
| 3,528,704 | 9/1970 | Johnson, Jr. . | |
| 3,713,699 | 1/1973 | Johnson, Jr. . | |
| 3,785,560 | 1/1974 | Hruby, Jr. . | |

(List continued on next page.)

OTHER PUBLICATIONS

Quinn and Marsters, "Upstream influence on turbulent jet flows from cruciform nozzles", *Aeronautical Journal,* Feb., 1985.

Aqua–Dyne, Inc. brochure entitled "Shape Up Your Waterblasting Performance", 1993.

Ho and Gutmark, "Vortex induction and mass entrainment in a small–aspect–ratio elliptic jet", *J. Fluid Mech.,* vol. 179, pp. 383–405 (1987).

Chapter 9, "Incompressible Turbulent Flow," Unknown Source (undated).

Chapter 6, "Incompressible Potential Flow," Unknown Source (undated).

Dhanak and Bernardinis, "The evolution of an elliptic vortex ring", *J. Fluid Mech.,* vol. 109, pp. 189–216, 1981.

Kambe and Takao, "Motion of Distorted Vortex Rings", *Journal of the Physical Society of Japan,* vol. 31, No. 2, pp. 591–599, Aug., 1971.

(List continued on next page.)

*Primary Examiner*—Andres Kashnikow
*Assistant Examiner*—Lisa Ann Douglas
*Attorney, Agent, or Firm*—Alan H. Gordon & Associates, P.C.

[57] ABSTRACT

A method of conditioning a flow of fluid comprises the steps of introducing a fluid into a nozzle body having an opening defining an inlet, an opening defining an outlet, and an inner surface connecting the inlet and the outlet, directing the fluid introduced into the inlet of nozzle body over the inner surface, and applying a pressure to the fluid. The inner surface of the nozzle is asymmetric with respect to a centerline of the inlet to provide a first region outside the nozzle of relative maximum pressure and a second region outside the nozzle of relative minimum pressure, where the first and second regions are substantially the same distance from the outlet. A fluid-conditioning nozzle comprises an inlet having an edge defining a first circumference, an outlet, offset from and spaced apart from the inlet, having an edge defining a second circumference, smaller than the first circumference, and a transition surface extending between the inlet and the outlet. The transition surface has a continuously changing slope between the first and second circumferences. The nozzle is operable to provide a first region outside the nozzle of relative maximum pressure and a second region outside the nozzle of relative minimum pressure, where the first and second regions are substantially the same distance from the outlet.

13 Claims, 11 Drawing Sheets

U.S. PATENT DOCUMENTS

| | | | |
|---|---|---|---|
| 3,893,628 | 7/1975 | McCollum | 239/593 |
| 3,961,486 | 6/1976 | Granholm et al. | 138/119 |
| 4,123,800 | 10/1978 | Mazzei . | |
| 4,185,706 | 1/1980 | Baker, III et al. . | |
| 4,187,921 | 2/1980 | Garner . | |
| 4,236,674 | 12/1980 | Dixon . | |
| 4,262,757 | 4/1981 | Johnson, Jr. et al. . | |
| 4,378,853 | 4/1983 | Chia et al. . | |
| 4,391,339 | 7/1983 | Johnson, Jr. et al. . | |
| 4,392,534 | 7/1983 | Miida . | |
| 4,436,166 | 3/1984 | Hayatdavoudi et al. . | |
| 4,494,618 | 1/1985 | Radtke . | |
| 4,497,664 | 2/1985 | Verry . | |
| 4,512,420 | 4/1985 | Hayatdavoudi et al. . | |
| 4,519,423 | 5/1985 | Ho et al. . | |
| 4,542,798 | 9/1985 | Madigan . | |
| 4,567,954 | 2/1986 | Voight, III et al. . | |
| 4,582,149 | 4/1986 | Slaughter, Jr. . | |
| 4,603,750 | 8/1986 | Sorenson . | |
| 4,623,027 | 11/1986 | Vezirian . | |
| 4,687,066 | 8/1987 | Evans . | |
| 4,776,412 | 10/1988 | Thompson . | |
| 4,792,284 | 12/1988 | Straub et al. . | |
| 4,794,995 | 1/1989 | Matson et al. . | |
| 4,813,611 | 3/1989 | Fontana . | |
| 4,886,131 | 12/1989 | Cholet et al. . | |
| 4,957,242 | 9/1990 | Schadow et al. . | |
| 5,071,195 | 12/1991 | Komotzki . | |
| 5,101,918 | 4/1992 | Smet . | |
| 5,170,946 | 12/1992 | Rankin . | |
| 5,205,648 | 4/1993 | Fissenko . | |
| 5,494,124 | 2/1996 | Dove et al. . | |
| 5,632,349 | 5/1997 | Dove et al. | 175/393 |
| 5,653,298 | 8/1997 | Dove et al. | 175/67 |
| 5,785,258 | 7/1998 | Akin et al. | 239/590 |

OTHER PUBLICATIONS

Burley II et al., "Static Investigation of Circular–to–Rectangular Transition Ducts for High–Aspect–Ratio Nonaxisymmetric Nozzles", NASA Technical Paper No. 2534 (1986).

Gledzer and Ponomarev, "Instability of bounded flows with elliptical streamlines", *J. Fluid Mechn.,* vol. 240 pp. 1–30 (1992).

Marshall, "The effect of axial stretching on the three–dimensional stability of a vortex pair", *J. Fluid Mech.,* vol. 241, pp. 403–419 (1992).

Petersen and Clough, "The influence of higher harmonics on vortex pairing in an axisymmetric mixing layer", *J. Fluid Mech.,* vol. 239, pp. 81–98 (1992).

Kambe and Oshima, "Generation and Decay of Viscous Vortex Rings", *Journal of the Physical Society of Japan,* vol. 38, No. 1, pp. 271–280, Jul., 1975.

Riley, "Flows with concentrated vorticity: a report on EUROMECH 41", *J. Fluid Mech.,* vol. 62, part 1, pp. 33–39 (1974).

Raman et al., "The Flip–Flop Nozzle Extended to Supersonic Flows", NASA Technical Memorandum 105570, prepared for Tenth Applied Aerodynamic Conference, American Institute of Aeronautics and Astronautics, Palo Alto, California, Jun. 22–24, 1992.

Widnall, "The Structure and Dynamics of Vortex Filaments", Unknown Source, pp. 141–163, 1975.

Wells and Pessier, "Asymmetric Nozzle Sizing Increases ROP," Unknown source, Sep., 1993.

Aref, "Integrable, Chaotic, and Turbulent Vortex Motion In Two–Dimensional Flows," *Ann Rev. Fluid Mech.* 1983, 15:345–89.

Choi et al., "Measurement of Confined, Coaxial Jet Mixing With Pressure Gradient," *Journal of Fluids Engineering,* vol. 108, Mar. 1986, pp. 39–46.

Gad–el–Hak and Bushnell, "Separation Control: Review", *Journal of Fluids Engineering,* vol. 113, Mar. 1991, p. 5–30.

Ho and Huerre, "Perturbed Free Shear Layers," *Ann Rev. Fluid Mech.,* 1984, 16:365–424.

Maxworthy, "Turbulent vortex rings," *J. Fluid Mech.* (1974), vol. 64, Part 2, pp. 227–239.

Oshima, "Motion of Vortex Rings in Water," *Journal of the PHysical Society of Japan,* vol. 32, No. 4, Apr., 1972, pp. 1125–1131.

Ottino, "Description of mixing with diffusion and reaction in terms of the concept of material surfaces," *J. Fluid Mech.* (1982), vol. 114, pp. 83–103.

Ottino, "Mixing, Chaotic Advection, and Turbulence," *Annu. Rev. Fluid Mech.,* 1990, 22:207–53.

Yarin and Hetsroni, "Turbulence Intensity in Dilute Two–Phase Flows–3," *Int. J. Multiphase Flow,* vol. 20, No. 1, pp. 27–44, (1994).

Hycalog brochure entitled "Hycalog Hybrid PDC Drill Bits For Lower Cost Per Foot In Tough Formations", undated.

METHOD AND APPARATUS FOR CONDITIONING FLUID FLOW

This application is a continuation of U.S. application Ser. No. 08/825,124 filed Mar. 27, 1997, now issued as U.S. Pat. No. 5,921,476 which is a continuation of U.S. application Ser. No. 08/357,511 filed Dec. 16, 1994 now issued as U.S. Pat. No. 5,785,258, which is a continuation-in-part of U.S. application Ser. No. 08/134,085 filed Oct. 8, 1993 now issued as U.S. Pat. No. 5,494,124.

BACKGROUND OF THE INVENTION

The present invention relates to a method and apparatus for conditioning the flow of fluid. The invention is believed to have a wide variety of applications, especially in the fabrication and use of calibrated or focused nozzles to create a fluid jet having unique characteristics.

Nozzles are used to create fluid jets in industries such as the oil and gas industry, among other things, to inject and mix fluids and to cleanse and erode surfaces. For example, during oil and gas drilling operations, drilling bits tear away at rock in a well bore while nozzles inject jets of drilling fluid into the well bore. The jets of drilling fluid may be used to assist in the erosion or cleaning of rock from the surface of the well bore by aggressively impinging on the surface. The fluid jets also may be used to clean rock fragments from the teeth of the drill bits.

When a nozzle is used for the purpose of eroding or cleaning a surface, the nozzle creates a fluid flow that impinges upon that surface. In many applications, the fluid flow is a "single-phase" flow in which the fluid flowing through the nozzle is a substantially homogeneous liquid (e.g., water). When pressure is applied to a single-phase fluid in the nozzle, a single-phase fluid jet impinges upon the surface and imparts energy to particles at the surface. Frequently the energy transferred from the fluid jet to the surface particles imparts momentum to the surface particles, thereby separating the particles from the surface. Such a separation of surface particles leads to an erosion or cleaning of the surface.

Improved ability and efficiency in separating the particles from the surface have been achieved through "multi-phase" fluid flow. For example, "dual-phase" flow may occur when gases are introduced into the liquid flowing through the nozzle, and "three-phase" flow may occur when particulate materials are entrained along with gas and/or liquid into the fluid. Multi-phase flow produces different erosion or cleaning characteristics from single-phase flow.

The fluid flow produced by a nozzle also may mix fluids and particles both at and away from an impingement surface. In any fluid flow, the presence of turbulent kinetic energy (i.e., turbulence) creates agitation within the fluid. Agitation produces a mixing phenomenon in the fluid which is beneficial, for example, in combining eroded rock fragments with the flowing fluid, thereby enhancing the ability of rock fragments to be carried out of the drilling area.

While the use of fluid jets generally for eroding, cleaning and mixing is well known in the art, room for improvement exists. For example, energy transfer between fluid jets and impingement surfaces can be carried out with greater efficiency. In addition, agitation created by the presence of turbulent kinetic energy can be increased.

SUMMARY OF THE INVENTION

The invention provides improved eroding, cleaning and mixing capabilities in fluid flow. Greater levels of erosion, cleaning and mixing are achieved for the expended energy, and thus more efficient fluid flow is produced. Eroding and cleaning capabilities are enhanced, in part, because the invention produces a pressure maximum and a pressure minimum (e.g., a strong positive pressure and a strong negative pressure) at substantially the same axial distance from the source of the flow. Mixing capabilities are increased as a result of increased turbulent kinetic energy throughout the flow region. The invention may also produce a region of turbulent kinetic energy at substantially the same axial distance from the source of the maximum and minimum pressure regions. The invention may calibrate, or focus, fluid flow to provide minima and maxima in set locations.

The invention has utility in conjunction with an impingement surface. Fluid contacts the impingement surface in a manner that produces regions of positive and negative pressure at the surface. In addition, the fluid flow creates a region of turbulence which lies at the surface. As a result, the fluid flow not only imparts pressure to the impingement surface, but also pull material away from the surface. The fluid flow also enhances the effects of turbulence away from the impingement surface.

In general, in one aspect of the invention, a method of conditioning a flow of fluid includes the steps of introducing a fluid into a nozzle body, directing the fluid introduced into the nozzle body over an inner surface of the nozzle body, and applying a pressure to the fluid. The nozzle body has an opening defining an inlet and an opening defining an outlet. The inner surface of the nozzle body connects the inlet to the outlet and is eccentric throughout its longitudinal dimension. Applying pressure to the fluid provides a first region outside the nozzle of relative maximum pressure and a second region outside the nozzle of relative minimum pressure, where the first and second regions are substantially the same distance from the outlet.

Embodiments of the invention include the following features. The step of directing the fluid may comprise focusing the fluid such that the first region of relative maximum pressure and the second region of relative minimum pressure occur at a predetermined distance. The step of introducing a fluid into a nozzle body includes the additional steps of forming an axisymmetric inlet and forming an asymmetric outlet. The outlet may also be circular. The step of introducing a fluid may also include the step of forming an outlet which is symmetric-periodic or N-lobe periodic in shape, as well as the step of forming a circular inlet. The method of conditioning a flow of fluid may further include the step of directing the conditioned fluid against an impingement surface to provide a negative pressure thereon. The step of introducing a fluid into a nozzle body may comprise introducing liquid into the nozzle body or introducing gas into the nozzle body. This step also may comprise introducing a multi-phase flow into the nozzle body or introducing a particulate material into the fluid.

In general, in another aspect of the invention, a fluid-conditioning nozzle comprises an inlet having an edge defining a first circumference, an outlet having an edge defining a second circumference, and a transition surface extending between the inlet and the outlet. The second circumference is smaller than the first circumference and the outlet is offset from and spaced apart from the inlet. The transition surface is eccentric throughout its longitudinal dimension between the first and second circumferences, and the nozzle is operable to provide a first region outside the nozzle of relative maximum pressure and a second region outside the nozzle of relative minimum pressure, where the first and second regions are substantially the same distance from the outlet.

Embodiments of the invention include the following features. The inlet, the outlet, and the transition surface may be focused such that the first region of relative maximum pressure and the second region of relative minimum pressure occur at a predetermined distance. The outlet may be symmetric-periodic or N-lobe periodic in shape, and the inlet may be substantially circular in shape. The inlet and the outlet both may be substantially circular or substantially elliptical in shape. The transition surface may be linear or may curve between the first and second circumferences. The transition surface may also have a different slope at diametrically opposed locations at the circumference of the outlet. The nozzle may comprise cast metal or molded plastic.

In general, in another aspect of the invention, a fluid-conditioning nozzle comprises a substantially circular inlet having a first radius $R_1$ and a first centerline, a substantially circular outlet having a second radius $R_2$ and a second centerline, and a transition surface extending between the inlet and the outlet. The second radius $R_2$ is smaller than the first radius $R_1$. The second centerline is parallel to the first centerline, and the first and second centerlines are offset a radial distance d from each other. The inlet and the outlet are spaced apart in axial distance L from each other. The transition surface has a longitudinal cross-section defining a first edge with a first slope $A_1$ and a second edge with a second slope $A_2$, where the first edge and the second edge are at diametrically opposed locations on the transition surface. The first slope $A_1$ and the second slope $A_2$ are defined by the equation:

$$\tan A_1+\tan A_2=(2R_1-2R_2)/L.$$

The radial distance d is defined by the equation:

$$d=R_1-R_2-L(\tan A_2).$$

The inlet, the outlet and the transition surface are cooperable to provide a first region outside the nozzle of relative maximum pressure and a second region outside the nozzle of relative minimum pressure, where the first and second regions are substantially the same distance from the outlet. In specific embodiments of the invention, the first and second cross-sectional edges may be either linear or curved.

In general, in another aspect of the invention, a method of manufacturing a nozzle comprises the steps of forming an inlet and an outlet in a nozzle body, the inlet and the outlet being eccentric, joining the inlet and the outlet with a transition surface having an edge of first perimeter at a first end in contact with the inlet and having an edge of second perimeter at a second end in contact with the outlet, and tapering the transition surface through the nozzle body such that the second edge perimeter is smaller than the first edge perimeter. The inlet, the outlet and the transition surface cooperate to define a fluid passage through the nozzle body, and the nozzle is operable to provide a first region outside the nozzle of relative maximum pressure and a second region outside the nozzle of relative minimum pressure, where the first and second regions are substantially the same distance from the outlet. In specific embodiments of the invention, the step of tapering the transition surface may comprise forming either a linear surface or a curved surface through the nozzle body, and the inlet and the outlet may be either substantially circular, substantially elliptical, or periodic in shape.

Other features and advantages of the invention will become apparent from the following description of the preferred embodiments and from the claims.

BRIEF DESCRIPTION OF THE DRAWINGS

Embodiments of the invention are described below, with reference to the following drawings.

DESCRIPTION OF PRIOR NOZZLES

Figure 1:
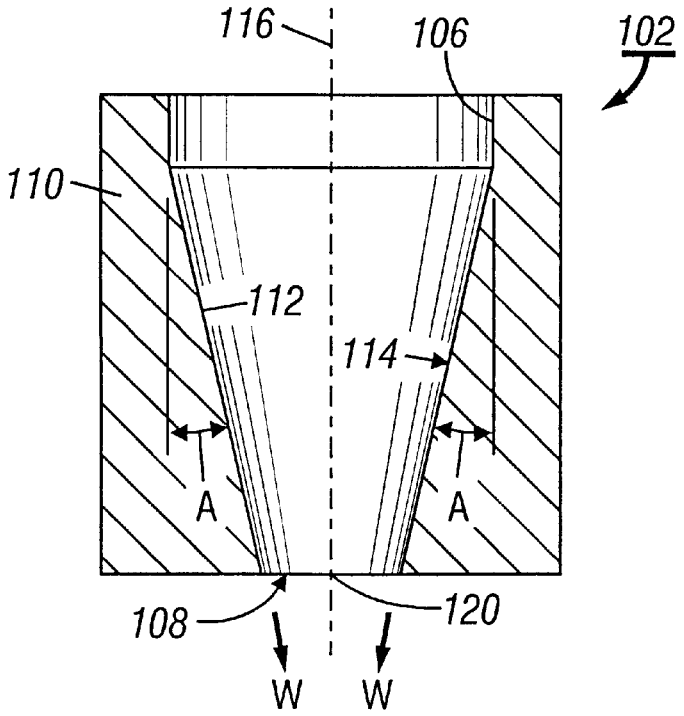
FIG. 1 (Prior Art)
FIG. 1 is a cross-sectional view in a longitudinal plane of a prior fluid nozzle.

Referring to FIG. 1, fluid enters a typical nozzle 102 though a cylindrical inlet 106 and exits the nozzle 102 through a circular outlet 108, which is concentric with and diametrically smaller than the inlet 106. Between the inlet 106 and the outlet 108 is a tapering transition surface 112, which forms a conical nozzle passage 114 in the nozzle body 110. A longitudinal centerline 116 exists though the inlet and the nozzle passage 114, and defines the center 120 of the outlet 108. At all points around its perimeter, the transition surface 112 forms a constant angle A with respect to the longitudinal centerline 116, and thus is axisymmetric in shape. An axisymmetric body is one which mirror images itself in any longitudinal, cross-sectional plane.

As fluid flows through the inlet 106, the transition surface 112 alters the dynamics of the flow, forcing the fluid to converge toward the centerline 116. Because the fluid passage 114 is axisymmetric, fluid flows through the outlet 108 with substantially uniform magnitude of velocity and at a substantially uniform angle with the centerline 116 at all points of equal radial distance from the centerline 116. For example, fluid flowing directly adjacent the transition surface 112 leaves the outlet 108 with a velocity of magnitude w and at an angle A with respect to the centerline 116 at all points around the perimeter of the outlet 108. Thus, like the nozzle itself, the flow of fluid from the nozzle is axisymmetric about the longitudinal centerline 116.

Figure 2:
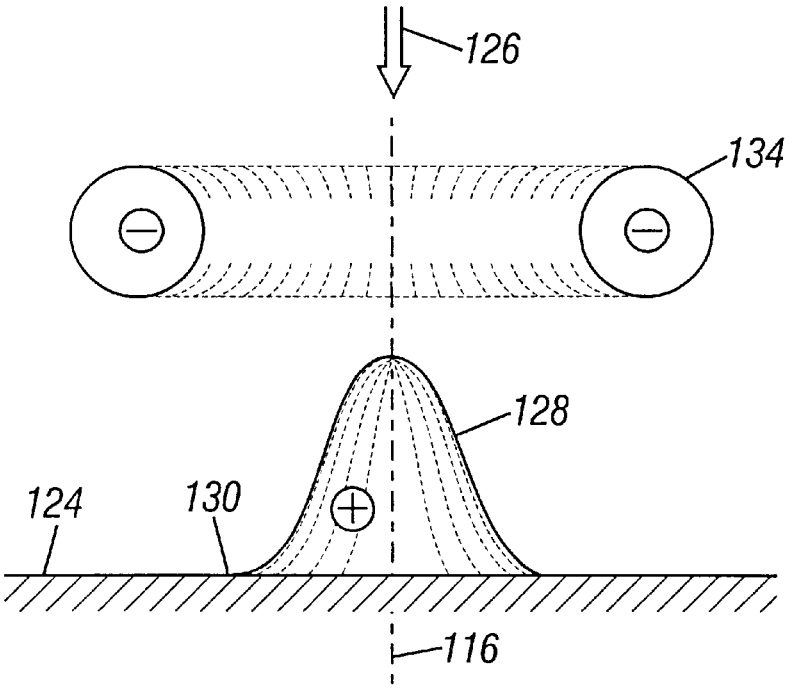
FIG. 2 (Prior Art)
FIGS. 2 through 4 show regions of pressure and turbulence created by prior fluid nozzles.

Referring to FIG. 2, fluid flowing from the outlet 108 may impinge upon a surface 124 substantially normal to the general direction 126 of the fluid flow. As this happens, a region of positive impingement pressure 128 occurs at the surface 124 by action of the fluid (i.e., the fluid "pushes" on the surface). The point of greatest positive pressure on the impingement surface 124 occurs at the centerline 116. At points increasingly distant from the centerline 116, the magnitude of positive pressure on the surface 124 tends to decrease. At some location 130 along a radial path from the centerline 116, the fluid exerts no substantial impingement pressure on the surface.

Figure 3:
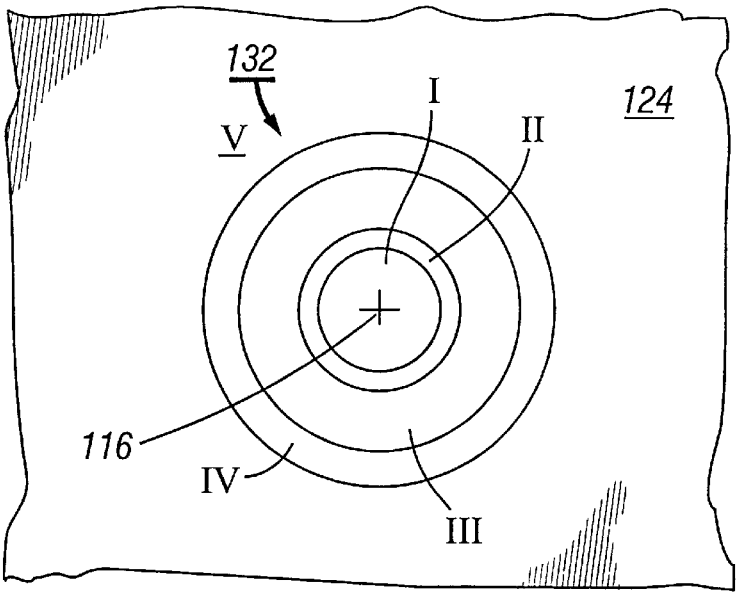
FIG. 3 (Prior Art)

As may be seen in FIG. 3, regions of substantially equal impingement pressure are represented by pressure contour lines 132, as viewed from the nozzle. Region I is the region of greatest impingement pressure, with the most positive fluid pressure lying on the centerline 116. The impingement pressure in region II is lower than that of region I but greater than the pressure in region III, which in turn is greater than the pressure in region IV. In all of regions I through IV, the fluid flow exerts a positive impingement pressure upon the surface 124. Region V covers the remainder of the impingement surface, upon which the fluid flow exerts no significant impingement pressure.

Referring again to FIG. 2, fluid flowing from the nozzle 102 also creates a region of negative pressure 134. This toroidal region of negative pressure 134 is axisymmetric about the centerline 116 and distanced in the axial direction from the impingement surface 124. The negative pressure region 134 results when fluid flows away from the centerline 116 and forms eddy currents.

Figure 4:
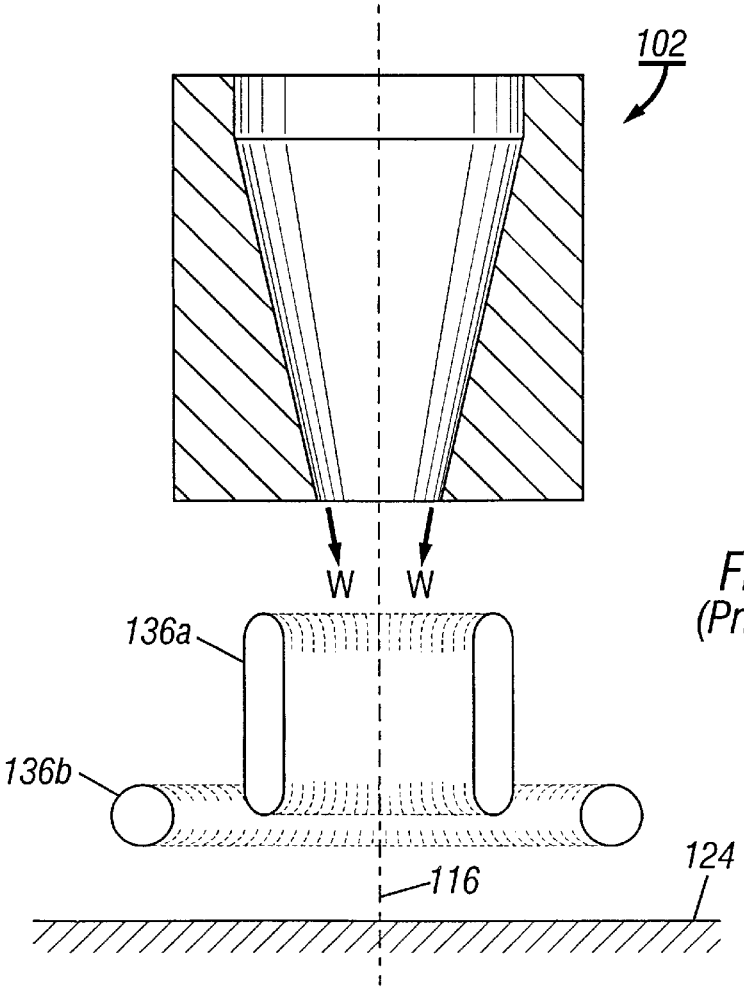
FIG. 4 (Prior Art)

As depicted in FIG. 4, the flow of fluid from the typical nozzle 102 also produces axisymmetric regions of turbulence 136*a* and 136*b*. Turbulence in zone or region 136*a* is in the shape of a hollow cylinder, axisymmetric about the centerline 116. Turbulence in zone or region 136*b* is toroidal in shape, is wider in diameter than region 136*a* and surrounds the end of region 136*a* closest to the impingement surface. Together, regions 136*a* and 136*b* form an axisymmetric "top hat-shaped" region of turbulence that surrounds the longitudinal centerline 116 and that is axially distanced from the impingement surface 124.

Non-axisymmetric nozzles are also known in art. These nozzles typically have a circular inlet and non-circular outlet, with a common centerline passing throughout the nozzle. The characteristics of non-axisymmetric nozzles known in that art are similar to those of the axisymmetric nozzle described above.

DESCRIPTION OF THE PREFERRED EMBODIMENTS

Figure 5:
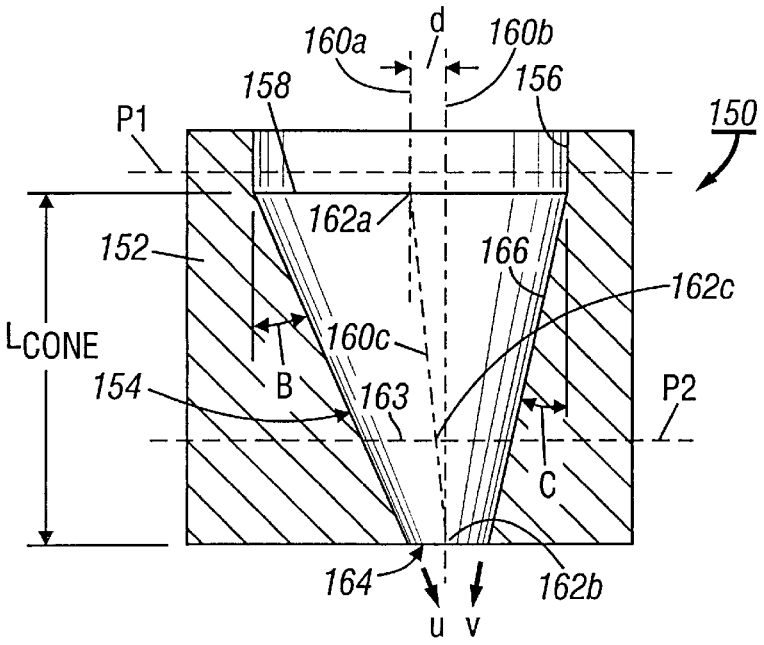
FIGS. 5 and 6 are longitudinal cross-sectional views of nozzles in accordance with the present invention.

Referring to FIG. 5, a nozzle 150 fashioned in accordance with the present invention includes a generally cylindrical nozzle body 152 in which a fluid passage 154 is formed. The nozzle body may be made of many different types of materials, depending upon the application. In downhole drilling applications, for example, the nozzle must be of great strength with high abrasive resistance, so a strong metal, such as tungsten, preferably should be used. For less rigorous applications, such as hot tubs, spas and the like, the nozzle may be made of a plastic or a ceramic material. The fluid passage 154 is preferably formed by milling the nozzle body with a numerically controlled automated machine tool. However, any suitable means may be used, including casting or molding.

At one end of the fluid passage 154 is an inlet throat 156 of generally circular cross-section in axial plane P1 (FIG. 5). At the other end of the fluid passage 154 is a generally circular outlet 164 of smaller diameter, and thus smaller circumference, than the inlet throat 156. The inlet throat 156 and the outlet 164 have parallel centerlines, denoted 160*a* and 160*b*, respectively, which are offset by a radial distance d. Thus, the inlet throat 156 and outlet 164 are eccentric, i.e., they do not share a centerline.

Between the inlet throat 156 and outlet 164, the fluid passage 154 defines a transition surface 166. The transition surface is a linear surface of generally circular cross-section in any axial plane P2 (FIG. 5). Because the inlet throat 156 and the outlet 164 are eccentric, the transition surface 166 forms a non-axisymmetric "offset cone." A transition centerline 160*c* intersects the inlet centerline 160*a* where the transition surface 166 meets the inlet throat 156 to form an edge, or transition inlet 158, and intersects the outlet centerline 160*b* at the outlet 164. Transition centerline 160*c* is a "centerline" in the sense that, for any axial plane P2 (FIG. 5), the centroid 162 of the circular cross-section of the transition surface 166 lies on the transition centerline 160*c*.

When viewed in longitudinal cross-section, the transition surface 166 forms diametrically opposed angles B and C (FIG. 5) with respect to centerlines 160*a* and 160*b*. The relationship between the angles is determined by the equation:

$$\tan B+\tan C=(2R_c-2R_j)/L_{CONE}$$

where $R_c$ is the radius of the transition inlet 158, $R_j$ is the radius of the outlet 164, and $L_{CONE}$ is the axial distance between the transition inlet 158 and the outlet 164. The offset d of centerlines 160*a* and 160*b* is determined by the equation:

$$d=R_c-R_j-(\tan C)L_{CONE}$$

Figure 11:
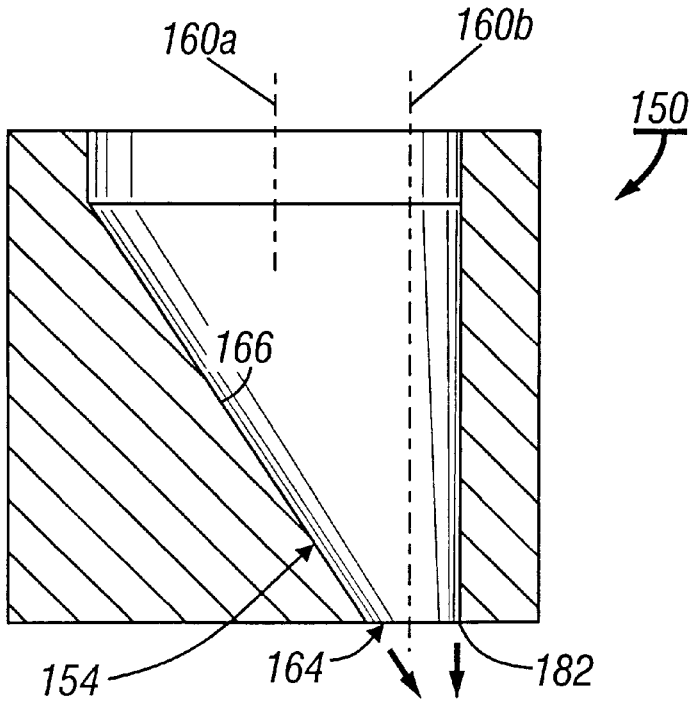
FIGS. 11 and 12 are longitudinal cross-sectional views of alternative nozzles in accordance with the present invention.
Figure 12:
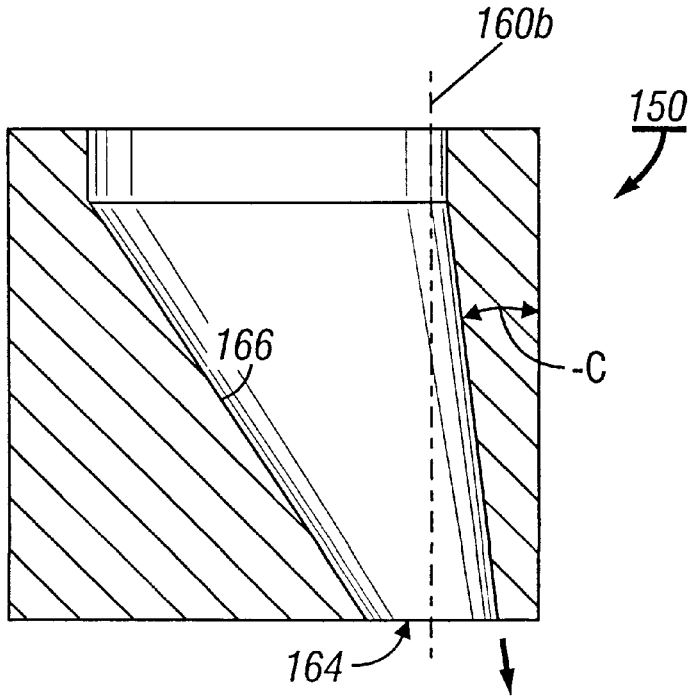

The offset "cone" is typically constructed such that angles B and C are both between 0° and 50°. A "cone" in which one of the angles B and C equals 0° is shown in FIG. 11. The "cone" may also have a region in which the transition surface forms negative angles, as shown in FIG. 12.

Because the geometric slope continuously changes around the perimeter of the transition surface 166, fluid exits the passage 154 at velocities which continuously vary in magnitude and angle in both the radial and angular directions with respect to the outlet centerline 160*b*. Fluid flowing along the transition surface 166, for example, passes diametrically opposed points of the outlet 164 with velocity vectors u and v (FIG. 5). Velocity vector u forms an angle B with centerline 160*b*, whereas velocity vector v, of smaller magnitude than vector u, forms an angle C with outlet centerline 160*b*. Between the vectors u and v, no two adjacent outflow vectors along the perimeter of the outlet 164 have equal magnitude or form the same angle. Thus, the offset cone nozzle creates a fluid jet that is asymmetric about the outlet centerline 160*b*. This asymmetry has been found to have beneficial results, as will be discussed in more detail below.

Figure 6:
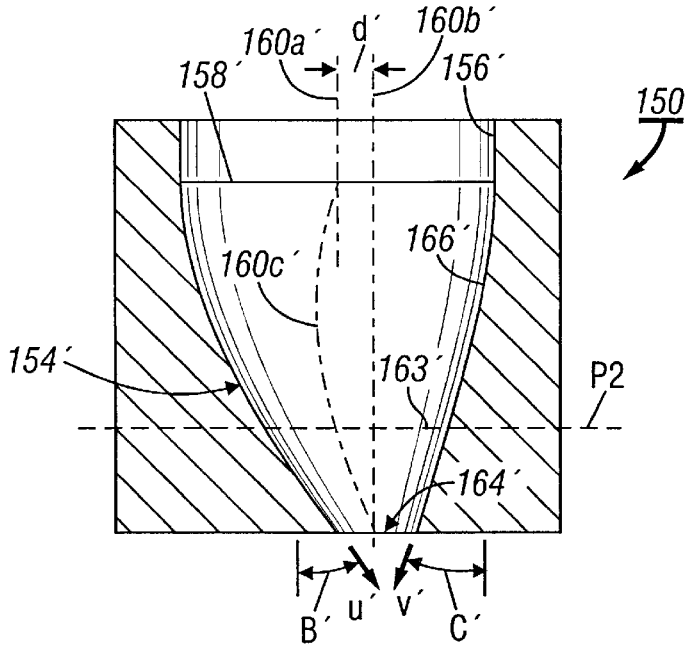

Referring to FIG. 6, in an alternative form, the fluid passage 154' may be defined by a non-linear transition surface 166' between the inlet throat 156' and outlet 164'. As with the linear nozzle, the inlet centerline 160*a*' and the outlet centerline 160*b*' are offset by a radial distance d' (FIG. 6). However, instead of abutting the inlet throat 156' with a different slope, the slope of the transition surface 166' at the inlet throat 156' is substantially equal to the slope of the inlet wall. The transition surface 166' then gradually changes the slope of the passage 154' between the inlet throat 156' and outlet 164'. At the outlet 164', the transition surface 166 forms diametrically opposed angles B' and C' with centerline 160*b*', as discussed with respect to the linear-surface nozzle above. As with the linear-surface nozzle, fluid flows out of the non-linear-surface nozzle with diametrically opposed velocity vectors u' and v' (FIG. 6). In FIG. 6, if d=0 (i.e., if the inlet throat 156' and outlet 164' are coaxial), then the inlet throat 156' and the outlet 164' are symmetric, but the transition surface 166' remains asymmetric with respect to the inlet centerline 160*a,b*. In the embodiments of FIGS. 5 and 6, for most, and preferably all, axial cross-sections of the transition surface, the centroid of the cross-sectional region 163 does not lie on the inlet centerline 160*a*.

Figure 10:
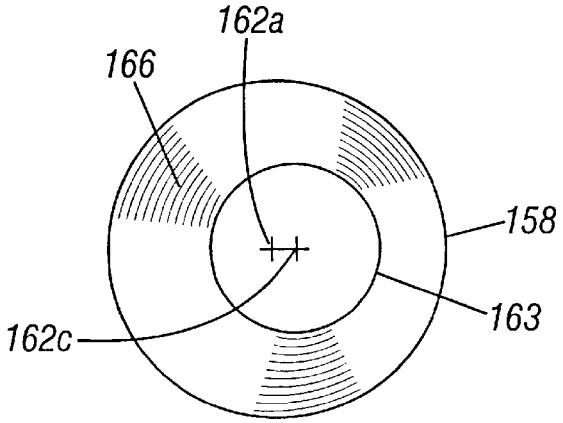
FIG. 10 is an end view of the nozzles of FIGS. 4 and 5.

FIG. 10 is an inlet end view of the nozzle of either FIG. 5 or FIG. 6 that illustrates the cross-sectional region 163 formed where the axial plane P2 intersects the transition surface 166. The centroid 162*c* of the region 163 is the geometric center of the region, i.e., the two-dimensional "center of mass." In the preferred embodiments, the centroid 162*c* does not coincide with the center 162*a* of the inlet 158, and thus does not lie on the inlet centerline 160*a*. In FIG. 10, the inlet centerline 160*a* runs normal to the page, intersecting the page at the centroid 162*a* of the inlet. The transition centerline 160*c* is the locus of the centroids of every axial cross-sectional region in the transition surface 166. The transition surface is therefore eccentric throughout its longitudinal dimension.

Figure 7:
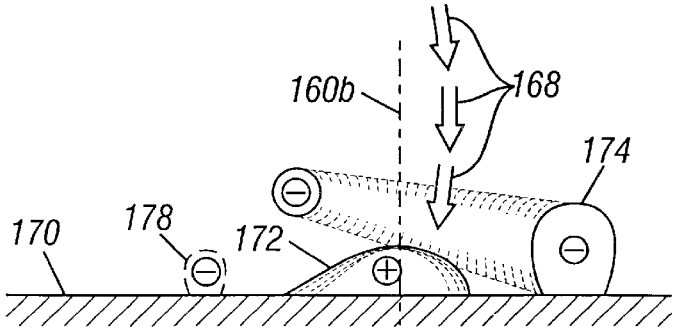
FIGS. 7 through 9 show regions of pressure and turbulence created by the nozzles of FIGS. 5 and 6.

Referring to FIG. 7, the fluid jet produced by the nozzle 150 follows a generally curved path 168 toward an impingement surface 170. As a result, the general thrust of the flow of fluid impinges the surface 170 at an angle, with respect to centerline 160*b*, which is normal to the impingement surface 170. Non-normal impingement of the fluid produces on the impingement surface 170 a region of positive pressure 172, the magnitude distribution of which resembles an egg-shaped dome. The region of maximum pressure lies in the vicinity of the intersection between the centerline 160*b* and the surface 170.

In addition, the fluid flow produces a region of negative pressure 174, which in shape resembles an irregular torus that is asymmetric about centerline 160*b*. The region of negative pressure bends toward the impingement surface 170, such that at least a portion, and preferably a large portion, of the negative pressure region 174 lies on the impingement surface 170. As a result, the regions of relative maximum and minimum pressure are formed at substantially the same distance from the nozzle 150. The nozzle 150 may be focused such that the regions of relative maximum and minimum pressure occur at predetermined distances from the outlet 164' (FIG. 6).

Figure 8:
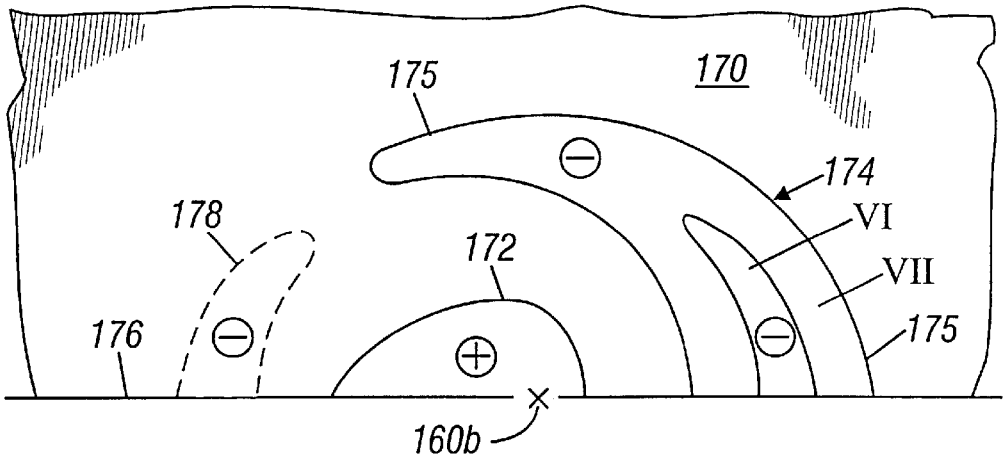

Referring to FIG. 8, contour lines around line-of-symmetry 176 show that a primary negative pressure region 174 is established at the impingement surface 170 in a generally crescent-like or horseshoe-like shape. The greatest negative pressure upon the surface 170 lies in a crescent-shaped maximum negative pressure region VI, and the pressure becomes decreasingly negative until it reaches substantially zero at the extremities 175 of a crescent-shaped intermediate negative pressure region VII. In addition to the primary negative pressure region 174, a secondary negative pressure region 178 may form on the impingement surface 170, centered at a position diametrically opposed to the maximum negative pressure region VI. At very high flow rates an entire torus of negative pressure 174 may be established at the impingement surface 170, so that a complete ring of negative pressure is formed around the outside of the positive pressure region 172. The radial distances between the positive pressure region 172 and the negative pressure regions 174 and 178 depend upon the geometry of the perimeter of the outlet 164 and the transition surface 166, as well as the fluid flow parameters such as flow rate, viscosity, and the like.

The regions of positive and negative pressure produced by the nozzle 150 on the impingement surface 170 lead to advantages before unrealized in the art. For example, the enlarged region of positive pressure 172 (FIG. 8) leads to greater erosion and cleaning of the surface. The regions of negative pressure 174 and 178 (FIG. 8) create a "pulling" action on the surface, thus enabling the fluid to tear material or particles away from the surface. With a nozzle fashioned in accordance with the present invention, the ability of fluids to clean and erode solid surfaces is significantly enhanced.

Figure 9:
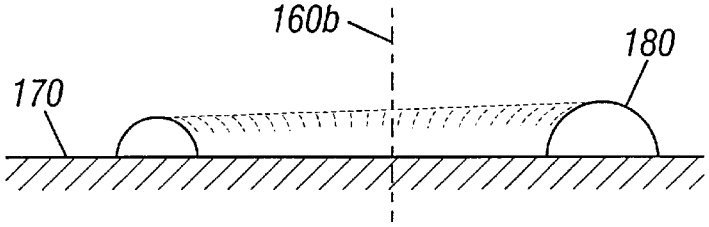

Referring to FIG. 9, in addition to the negative pressure regions, fluid flowing from the nozzle produces a region of turbulent kinetic energy 180 which is established at the impingement surface 170. Like the negative pressure region, the region of turbulence 180 is asymmetric, and it resembles an irregular truncated torus that substantially continuously acts upon the impingement surface 170. The region of turbulence 180 also may be concentrated or focused into a single, non-toroidal region on the impingement surface, depending upon flow conditions. Such a non-toroidal region may be tuned to coincide with a region of maximum negative pressure, or it may be offset some angle about the outlet centerline 160*b* from the regions of maximum negative pressure, again depending upon flow conditions and nozzle geometry. Fluid flowing from the nozzle also enhances other regions of turbulent kinetic energy throughout the well bore.

The turbulent kinetic energy produced by the fluid flow from the nozzle 150 is believed to be at least three times as great as that from the prior art nozzle of FIG. 1. Turbulent kinetic energy may be defined as the dot product of the time averaged velocity vector fluctuations v', or $\rho \cdot K$, where $\rho$ is the mass density of the fluid, and K is the "turbulence measure," both well-known in the art. For the velocity vector v having fluctuation components $v'_1$, $v'_2$ and $V'_3$, turbulence measure is defined by the equation:

$$K=\tfrac{1}{2}\langle v'_1{}^2+v'_2{}^2+v'_3{}^2\rangle$$

Experimental data has shown that for nozzles according to the invention, K is at least three times that of the prior art nozzle of FIG. 1. One result is that the fluid flow from nozzle 150 has enhanced fluid mixing qualities over known nozzles.

Referring to FIG. 11, the nozzle 150 also may be constructed such that, at a predetermined location 182, the transition surface 166 has zero slope and thus runs parallel to centerlines 160*a* and 160*b*, forming a "right-angle" cone.

In this embodiment, the angle formed between the fluid jet and centerline 160*b* continuously changes around the perimeter of the outlet 164 until, at the location of zero slope 182, fluid exits the nozzle in a direction normal to the impingement surface.

Referring to FIG. 12, a further alternative embodiment is shown. In particular, the nozzle 150 may be further modified so that the angle formed between the transition surface 166 and centerline 160*b* not only reaches zero, but becomes negative, reaching a maximum negative angle of −C. In regions where the slope of the transition surface 166 is negative, fluid flowing through the outlet 164 will actually diverge from centerline 160*b*.

Figure 13:
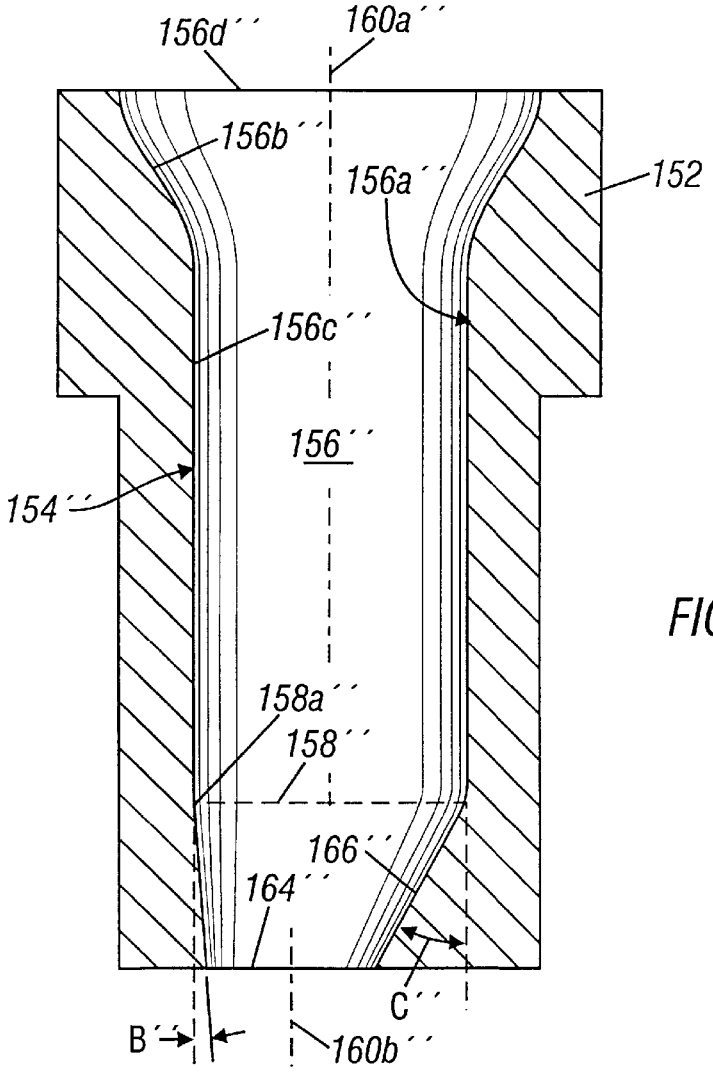
FIGS. 13 and 14 are a longitudinal cross-sectional view and an end view of an alternative nozzle in accordance with the present invention.
Figure 14:
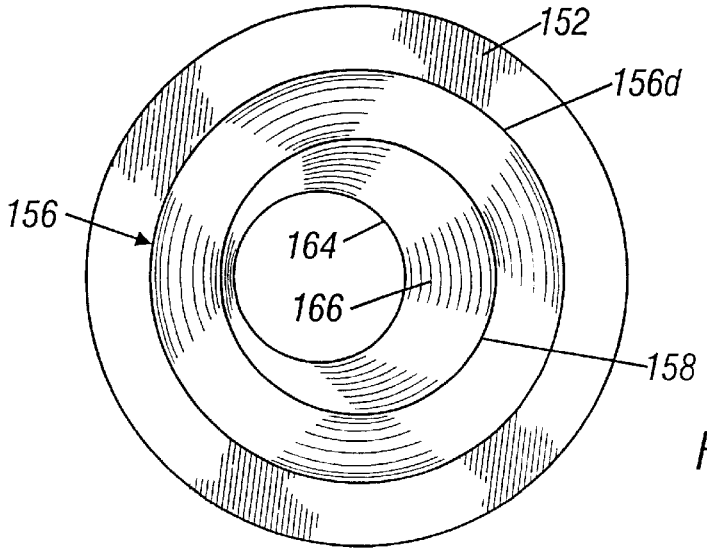

FIGS. 13 and 14 show another alternative embodiment. FIG. 13 is a longitudinal cross-section of the nozzle and FIG. 14 is the nozzle as viewed through the inlet throat 156". The inlet throat 156" of the fluid passage 154" is defined by a surface 156*a*" of substantially circular cross-section comprising a tapering neck 156*b*" that abuts a substantially cylindrical portion 156*c*". The tapering neck 156*b*" allows the inlet surface 156*a*" to transition from the larger diameter of the inlet mouth 156*d*" to the smaller diameter of the transition inlet 158". From the transition inlet 158", the transition surface 166" tapers toward the eccentric outlet 164" at diametrically opposed angles B" and C", preferably of 5° and 35°, respectively. The outlet 164" is also generally circular and of smaller diameter than the transition inlet 158". At the transition inlet 158", the transition surface 166" and the inlet surface 156*a*" do not meet at different angles, but rather cooperatively form a rounded intersection 158*a*" to ensure smooth transition between the two surfaces.

In each of the embodiments of FIGS. 11 through 14, the centroid of each axial cross-sectional region lies on a transition centerline which does not coincide with the inlet centerline 160*a*. The effects on fluid flow of these alternative embodiments are similar to those of the nozzles of FIGS. 4 and 5.

Figure 15:
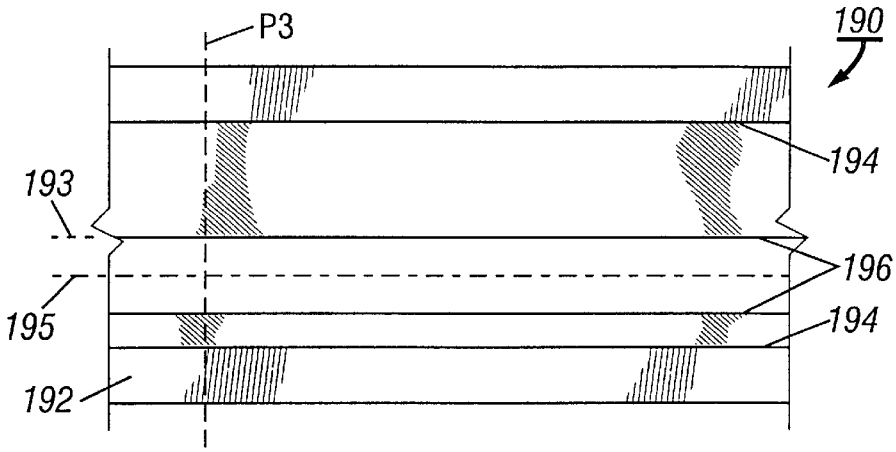
FIG. 15 is end view of an alternative embodiment of a nozzle in accordance with the present invention.

Referring to FIG. 15, the offset cone geometry may also be used to form an elongated nozzle 190. In the elongated nozzle 190, a rectangular-cubical nozzle body 192 contains a rectangular inlet 194, whose width is greater than that of a rectangular outlet 196. The longitudinal centerline 195 of the outlet 196 is offset from the longitudinal centerline 193 of the inlet 194, so that a cross-section in plane P3 resembles the cross-section of the circular nozzle 150 of FIG. 5. Instead of creating a fluid jet, the elongated nozzle 190 creates a substantially planar fluid flow which may be used, e.g., as a fluid knife.

Figure 16:
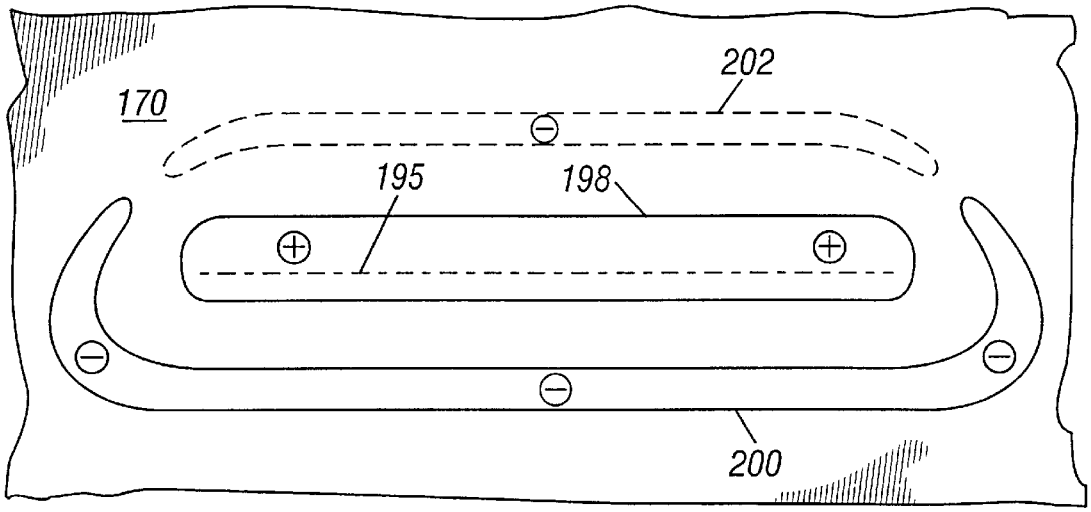
FIG. 16 shows regions of pressure created by the nozzle of FIG. 15.

Referring also to FIG. 16, the elongated nozzle 190 creates substantially elongated pressure regions having a relatively high aspect ratio when compared with the pressure regions of other nozzles depicted, e.g., in FIG. 8. A positive pressure region 198 is formed on the impingement surface 170 around the orthogonal projection of centerline 195. Surrounding the positive pressure region 198 is an asymmetric irregular loop of negative pressure, part of which intersects the impingement surface 170 in an elongated crescent-shaped region of negative pressure 200. A second, smaller region of negative pressure 202 may also be formed on the impingement surface 170, opposite region 200.

The elongated nozzle 190 provides the benefits of the circular nozzle but over a wider area and with a higher aspect ratio. This arrangement facilitates enjoyment of the benefits of the invention in applications such as seafood processing, textile treatment (e.g., carpet cleaning), paint removal, and other such applications. For example, the elongated nozzle 190 could be placed into a sweeper which, when passed over carpet, allows the positive and negative pressure regions to form on the carpet surface, thereby dislodging and removing particles from the carpet.

Figure 17:
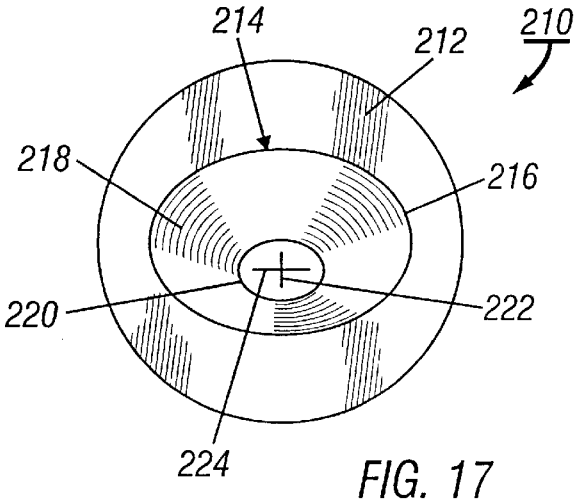
FIG. 17 is an end view of an alternative embodiment of a nozzle in accordance with the present invention.

Referring to FIG. 17, a further alternative embodiment is shown, whereby the nozzle of FIGS. 5 and 6 includes a nozzle passage that is non-circular in shape. The non-circular nozzle 210 comprises a nozzle body 212, into which an oblong conical fluid passage 214 is formed. The passage 214 has an oblong inlet 216, which is generally elliptical or ovular in shape. From the inlet 216, an elliptical-conical transition surface 218 tapers through the nozzle body 212 towards an oblong outlet 220 of smaller perimeter than the inlet 216. The center of the outlet 220 is offset from the center of the inlet 216. This offset may be along the minor axes 222 of the inlet 216 and outlet 220, the major axes 224, or some combination of the two (major and minor axes, as used here, do not necessarily conform to the meaning of these terms as used in the mathematical definition of an ellipse). The inlet and the outlet also may be rotated with respect to each other, e.g., by 90°, so that the minor axis of the inlet 216 is parallel to the major axis of the outlet 222, and vice versa. The dynamics of the fluid jet produced by the non-circular nozzle 210 are similar to those described above for the circular nozzle. However, certain advantages are provided by a nozzle having a higher aspect ratio.

Figure 18:
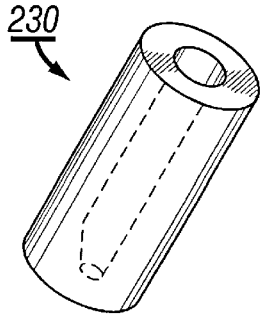
FIG. 18 is a perspective view of a nozzle in accordance with the present invention.

An improved nozzle in accordance with the invention may be used to replace the nozzles typically used in the art under either single-phase or multi-phase flow conditions. A useful application for the nozzle is in downhole drilling operations using tri-cone and fixed-cutter drill bits. As shown in FIG. 18, a substantially cylindrical nozzle 230 has a diameter as required by flow area limitations and is inserted into a drilling bit of size specific to the given applications in a manner known to those of skill in the art. As the drill bit is rotated within a well bore and, in the case of the tri-cone bit, as the roller cones tear away at the rock within the bore, pressure is applied to fluid in the nozzle 230, thereby creating a fluid jet. The fluid jet exits the nozzle 230 and impinges upon the teeth of the drill bit and/or the rock surface. Because of the features of the fluid flow described above, the teeth of the drill bits may be better and more efficiently cleaned, the rock surface may be better and more efficiently eroded, and/or the fluid within the well bore may be better and more efficiently mixed with cuttings than would be expected with prior nozzles. As a result, the drilling operation becomes faster and more efficient.

Figure 19:
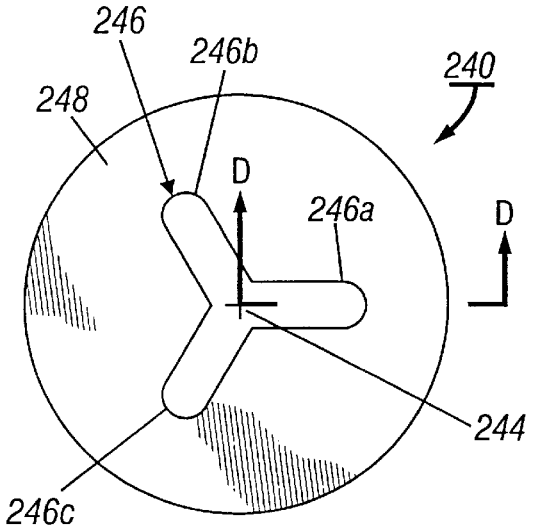
FIG. 19 is an outlet end view of a nozzle in accordance with the invention having a tri-legged slot outlet extending into a frustoconically shaped passageway.

Other alternative embodiments do not necessarily include a transition surfaces which are eccentric throughout, but instead may be formed with transition surfaces that are symmetric or axisymmetric about a centerline. Referring to FIG. 19, a nozzle 240 is depicted in end view. The nozzle 240 includes a nozzle body 248 which is substantially cylindrical in shape and centered along a longitudinal axis 244. Also centered on the longitudinal axis 244 is an outlet 246, in the form of a tri-legged or star-shaped slot, each leg 246*a*, 246*b* and 246*c* of which is of equal length from the longtiduinal axis 244. Line D—D on FIG. 19 denotes the location of the semi-cross-sectional view of the nozzle 240 along one leg 246*a*, as shown in FIG. 20.

Figure 20:
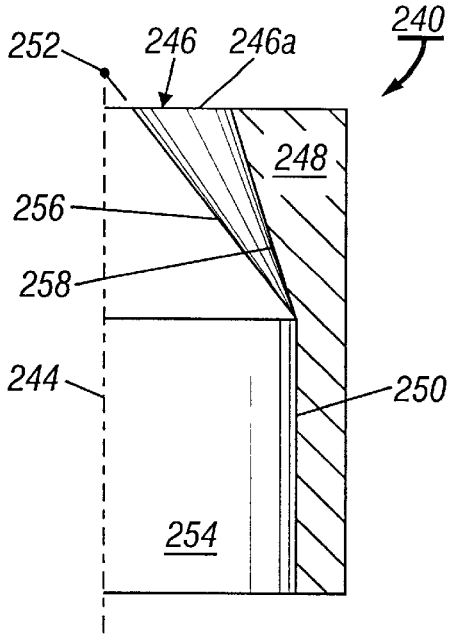
FIG. 20 is a longitudinal semi-cross-sectional view of the nozzle of FIG. 19.

Referring also to FIG. 20, nozzle body 248 defines a passageway 250, a semi-cross-sectional portion of which is shown. The passageway 250 includes an inlet throat 254 at the end of the nozzle body 248 opposite the outlet 246. Between the inlet throat 254 and the outlet 246 is a first transition surface 256 which tapers inwardly toward the longitudinal axis 244 at a predetermined angle (e.g., 35°) from the longitudinal axis 244. The first transition surface 256 defines a frustoconical surface, the imaginary apex of which lies on a point of projection 252 on the axis 244 outside the nozzle 240 and beyond the outlet 246. The passageway 250 includes a second transition surface 258 that intersects the first transition surface 256. The second transition surface 258 tapers inwardly at a greater angle than the first transition surface, forming a slotted shape in the less steeply rising first transition surface 256. Similar semi-cross-sectional portions are found in each of the other two legs 246*b* and 246*c* of the outlet 246.

Figure 21:
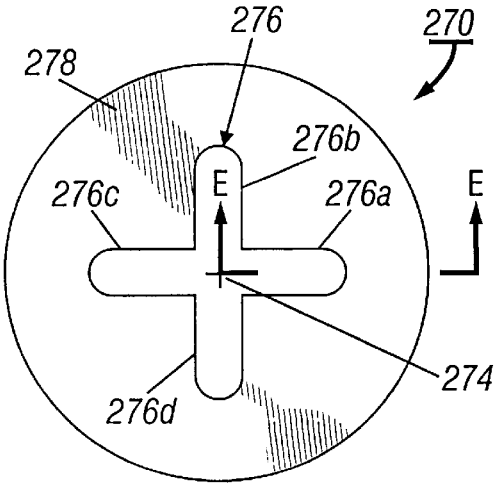
FIG. 21 is an outlet end view of a nozzle in accordance with the invention having a cross-shaped slot outlet extending into a frustoconically shaped passageway.

Referring to FIG. 21, a nozzle 270 includes a nozzle body 278 which is columnar in shape and centered along a longitudinal axis 274. Also centered on the axis 274 is an outlet 276 in the form of a four-legged or cross-shaped slot, each leg 276*a*, 276*b*, 276*c* and 276*d* of which is of equal length from the axis 274. Line E—E on FIG. 21 denotes the location of the semi-cross-sectional view of the nozzle 270 along one leg 276*a*, as shown in FIG. 22.

Figure 22:
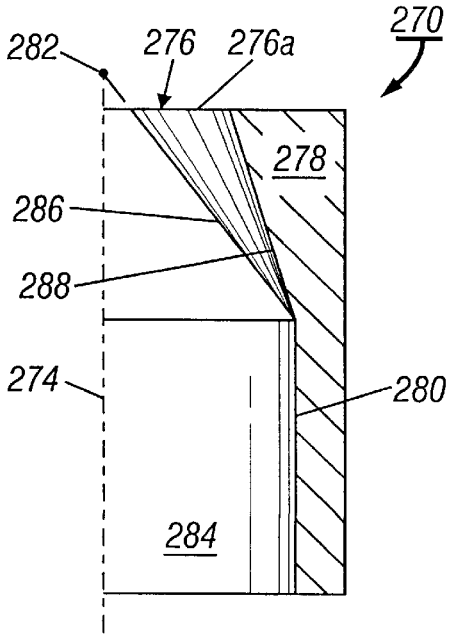
FIG. 22 is a longitudinal semi-cross-sectional view of the nozzle of FIG. 21.

Referring also to FIG. 22, the nozzle body 278 defines a passageway 280, a semi-cross-sectional portion of which is shown. The passageway 280 includes an inlet throat 284 at the end of the nozzle body 278 opposite the outlet 276. Between the inlet throat 284 and the outlet 276 is a first transition surface 286 which tapers inwardly toward the longitudinal axis 274 at a predetermined angle (e.g., 35°) from the longitudinal axis 274. The first transition surface 286 defines a frustoconical surface, the imaginary apex of which lies at a point of projection 282 on the axis 274 outside the nozzle 270 and beyond the outlet 276. The passageway 280 includes a second transition surface 288 that intersects the first transition surface 286. The second transition surface 288 tapers inwardly at a greater angle than the first transition surface 286, forming a slotted shape in the less steeply rising first transition surface 286. Similar semi-cross-sectional portions are found in each of the other three legs 276*b*, 276*c* and 276*d* of the outlet 276.

The nozzle of FIGS. 19 and 20 was tested in a fixture as follows. The nozzle body had an overall length of 2.75 inches, an outside diameter of 2.375 inches, a single leg width of 0.289 inches and a single leg length of 0.650 inches. Total area of the nozzle outlet was 0.5 $in^2$. A tank of dimensions 4.15 feet long, 3.69 feet wide and 2 feet deep having a capacity of 229.09 gallons was employed with a 3 by 2 centrifugal pump acting on water as a test fluid. A pressure/vacuum transducer model PU350 manufactured by John Fluke Manufacturing Company, Inc., capable of measuring 0–500 psig with full vacuum function, with analog to digital voltmeter readout was employed with a pressure measuring fixture comprising a flat plate translatable in two axes, one perpendicular to flow, the other parallel to flow. A ⅜ inch OD×3/16 inch ID nipple projected 3/16 inch above the plate. Pressure readings were taken at ¼ inch increments perpendicular to the flow from center of the jet to three inches radially outward from the centerline. Flow rate was 165 gpm, plate depth was 12 inches below the static waterline, nozzle discharge pressure was 68 psig static, pressure at the plate was 0 psig (transducer calibrated to read zero at 12 inches depth), the nozzle to plate distance was 1.625 inches, and water temperature was 100° F. The resulting first derivative topographical pressure profile is depicted in FIG. 23.

Figure 23:
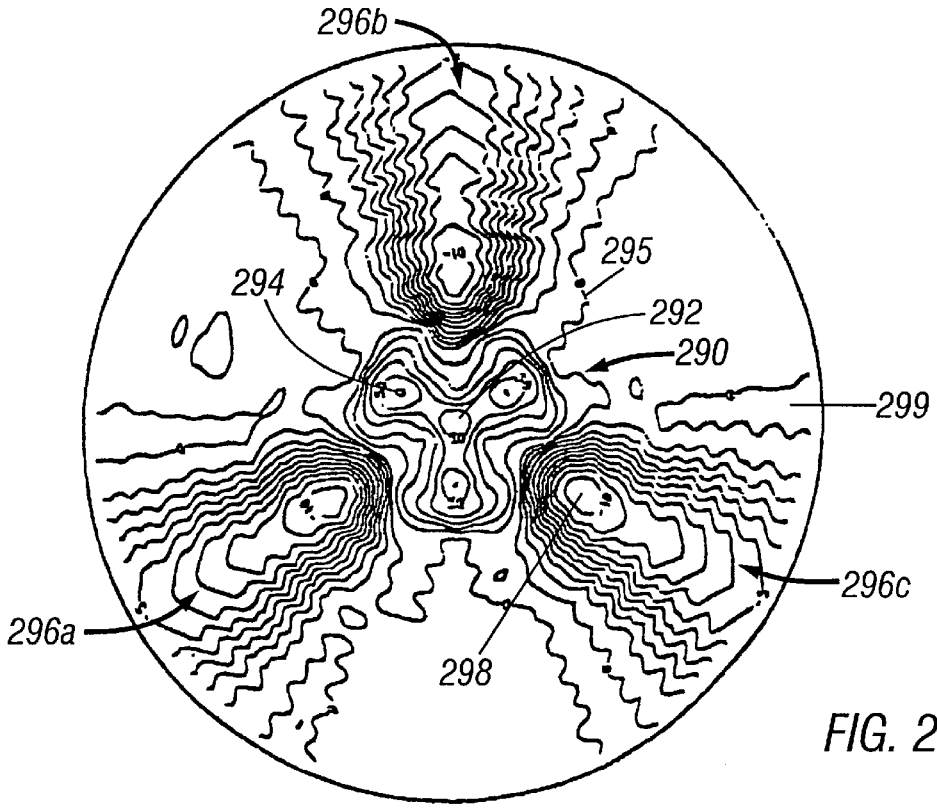
FIG. 23 is a diagram of contour lines of relative pressure projected by a fluid forced through the nozzle of FIGS. 19 and 20.

The mapped pressure profile of FIG. 23 shows that the nozzle of FIGS. 19 and 20 produces a tri-lobular zone 290 of positive hydrostatic pressure that degrades from a maximum positive value in a core portion 292 thereof at its center and at its lobes 294 to a zero reference value in distal peripheries 295 thereof. Furthermore, the nozzle of FIGS. 19 and 20 produces zones of negative hydrostatic pressure 296*a*, 296*b*, 296*c* adjacent and between each union of a lobe leg of the high pressure zone 290. Each of these zones of negative hydrostatic pressure degrades from a maximum negative value in a core portion 298 to a zero reference value at a distal pressure periphery 299. The negative zones are symmetrically spaced and substantially equidistant from adjacent leg extremities 295 of the core portion 292 of the positive zone 290.

The nozzle of FIGS. 21 and 22 was tested under the same conditions as the nozzle of FIGS. 19 and 20, except that the water temperature was 90° F. The nozzle body had an overall length of 2.75 inches, and outside diameter of 2.375 inches, a single cross arm width of 0.220 inches and a single cross arm length of 1.292 inches. Total area of the nozzle outlet was 0.5 $in^2$. The resulting first derivative topographical pressure profiles are shown in FIG. 24.

Figure 24:
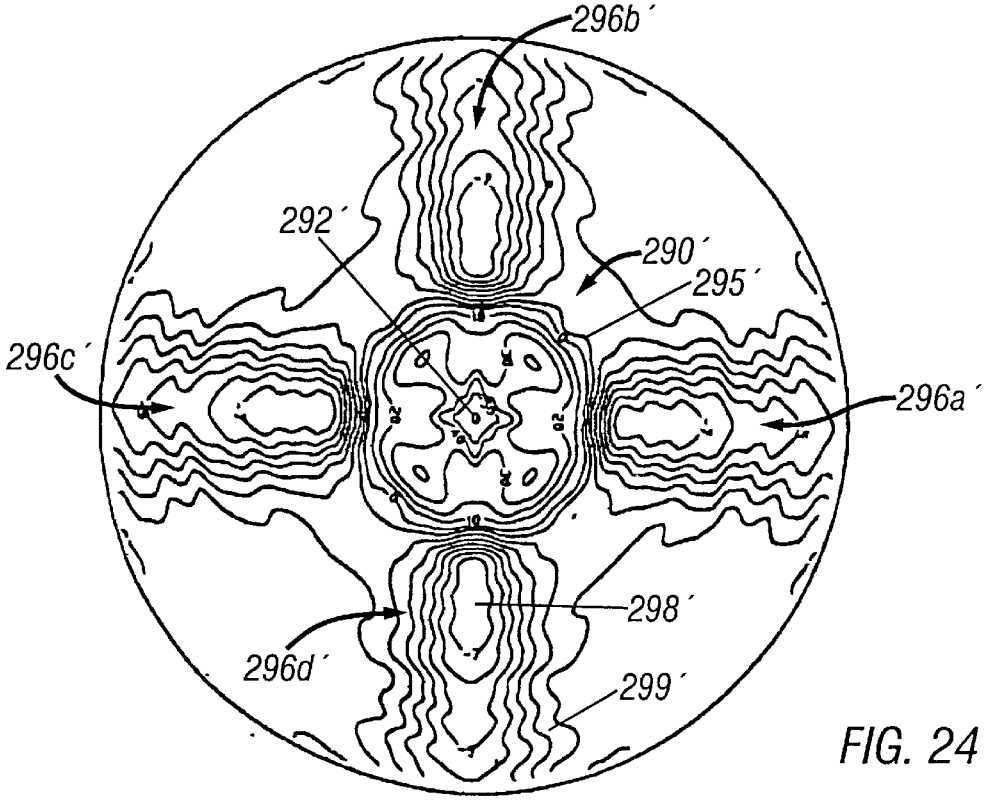
FIG. 24 is a diagram of contour lines of relative pressure projected by a fluid forced through the nozzle of FIGS. 21 and 22.

The mapped pressure profiles of FIG. 24 show that the nozzle of FIGS. 21 and 22 produces a cruciform zone 290' of positive hydrostatic pressures that degrades from a maximum positive value in a central core portion 292' thereof at its center to a zero reference value in distal peripheries 295' thereof. Furthermore, the nozzle of FIGS. 21 and 22 produces zones of negative hydrostatic pressure 296*a*', 296*b*', 296*c*', and 296*d*' adjacent and between each union of a cross arm of the high pressure zone 290'. Each of these zones of negative hydrostatic pressure degrades from a maximum negative value in a core portion 298' to a zero reference value at a distal pressure periphery 299'. The negative zones are symmetrically spaced substantially equidistant from adjacent arm extremities 295' of the core portion 292' of the positive zone 290'.

Figure 25:
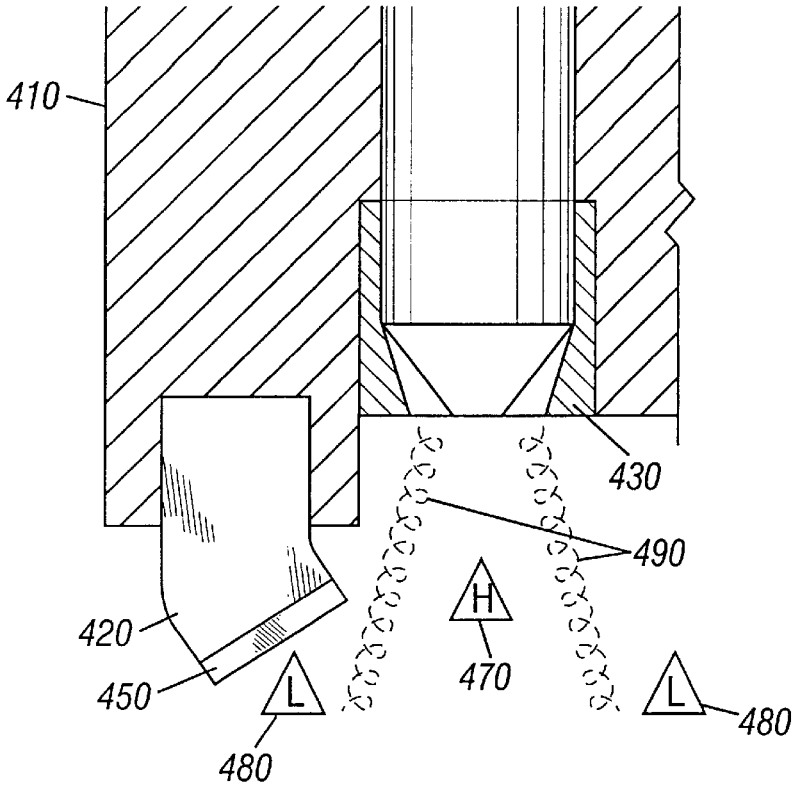
FIG. 25 is a schematic representation of a zone of negative hydrostatic pressure impinging a rock-cutter interface and zones of positive pressure along which fluid vortices are shedding.

Referring to FIG. 25, a nozzle 430 (as depicted in FIG. 19 or FIG. 21) is mounted in the body 410 of a drill bit. Fluid flowing from the nozzle forms vortices 490 just in front of the face 450 of a cutter 420 protruding from the bit body 410. High pressure areas 470 lie between the vortices 490, while low pressure areas 480 lie outside the vortices 490. The vortices 490 are essentially located around the periphery of the high pressure areas 470. This relationship between the vortices and the pressure zones, due to the design of the nozzle and its location in the drill bit, gives rise to the beneficial features of the nozzles of FIGS. 19 through 22.

Figure 26:
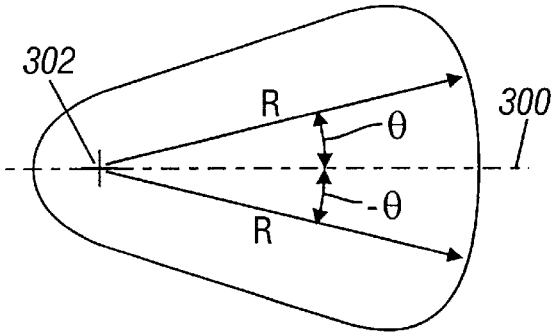
FIGS. 26 through 29 are alternative embodiments of an outlet perimeter of a nozzle in accordance with the invention.
Figure 27:
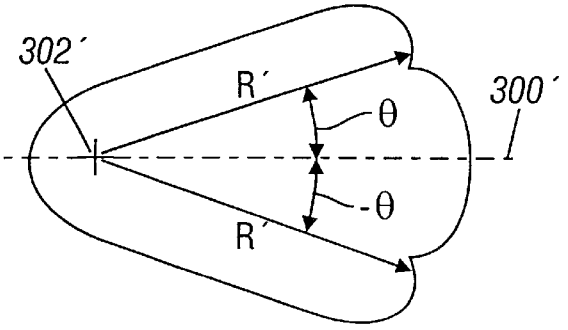

Referring to FIGS. 26 and 27, further alternative embodiments of the outlet are shown, in which the shape of the outlet is a "symnietric-periodic" curve. The symmetric-periodic outlet has a line-of-symmetry 300 (FIG. 26) or 300' (FIG. 27) containing a reference point 302 (FIG. 26) or 302' (FIG. 27). The outlet is formed such that for every angle θ and the corresponding angle −θ from the line of symmetry 300 (FIG. 26) or 300' (FIG. 27), the perimeter of the outlet is a predetermined radial distance R (FIG. 26) or R' (FIG. 27) from the reference point 302 (FIG. 26) or 302' (FIG. 27).

Figure 28:
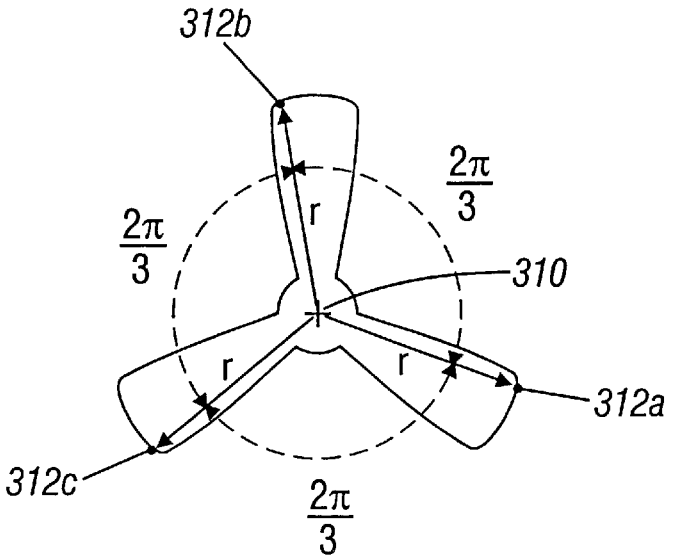
Figure 29:
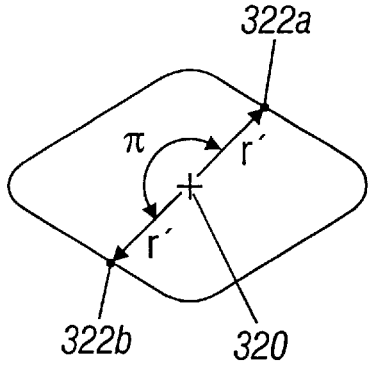

Referring to FIGS. 28 and 29, further alternative embodiments of the outlet are shown, in which the shape is an "N-lobe periodic" curve. The N-lobe periodic outlet has a centroid 310 (FIG. 28) or 320 (FIG. 29) from which the perimeter of the outlet is at the same radial distance r (FIG. 28) or r' (FIG. 29) at points 312*a*, 312*b*, and 312*c* (FIG. 28) or 322*a* and 322*b* (FIG. 29), separated from each other by an angle of 2π/N. FIG. 28 illustrates an embodiment having three lobes (N=3), and FIG. 29 illustrates an embodiment having two lobes (N=2).

Nozzles containing embodiments of the outlet as shown in FIGS. 26 through 29 preferably have a circular inlet. Because of the complex structure of the transition surface connecting the circular inlet to the illustrated outlets, it is not required, but is preferred, that the centroid of each axial cross-sectional region of the transition surface lie on a transition centerline that does not coincide with the inlet centerline.

Figure 30:
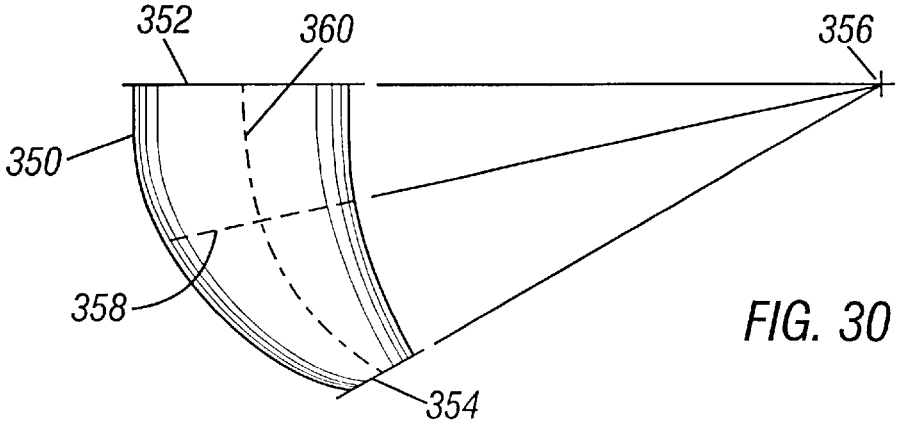
FIG. 30 is a longitudinal cross-sectional view of an alternative embodiment of a transition surface in accordance with the invention.

As shown in FIG. 30, an alternative embodiment of the transition surface is a "toroidal cone" 350. The transition surface 350 joins an inlet 352 and an outlet 354, both of which are circular, which lie in non-parallel planes having a line of intersection 356. The transition surface 350 is formed such that any plane containing the line of intersection 356 intersects the transition surface in a circular cross-sectional region 358. The "centerline" 360 of the transition surface 350 is the curve which contains the center points of every cross-sectional region of the toroidal cone created by planes containing the line of intersection 356.

Other embodiments are contemplated to fall within the scope of the following claims. The nozzle may be used in a wide variety of eroding, cleaning and mixing applications.

What is claimed is:

1. A method of conditioning flow of fluid, the method comprising:

(i) introducing a fluid into a nozzle having a first opening defining an inlet, a second opening defining an outlet, and a transition surface connecting the inlet to the outlet;

(ii) directing the fluid over the transition surface; and (iii) applying a pressure to the fluid to provide a first region outside the nozzle of positive pressure and a second region outside the nozzle of negative pressure, the first and second regions being substantially the same distance from the outlet.

2. The method of claim 1 wherein said directing step (ii) comprises focusing the flow of fluid such that the first region of positive pressure and the second region of negative pressure occur at a predetermined distance.

3. The method of claim 1 further comprising the step of directing the conditioned fluid against an impingement surface to provide a negative pressure thereon.

4. A fluid conditioning nozzle comprising:

a first opening defining an inlet and having a cross-sectional centerline;

a second opening defining an outlet and generally having substantially the shape of a parallelogram with no right angles; and a transition surface extending between the inlet and the outlet and defining a passageway through the nozzle; wherein the transition surface has a transition center line and wherein the inlet cross-sectional centerline and the transition centerline do not coincide.

5. The apparatus of claim 4 wherein the inlet, the outlet and the transition surface are cooperable to provide a first region outside the nozzle of positive pressure and a second region outside the nozzle of negative pressure, the first and second regions being substantially the same distance from the second opening.

6. The apparatus of claim 4 wherein the transition surface is eccentric throughout a longitudinal dimension of the nozzle.

7. The fluid conditioning nozzle of claim 4 wherein the inlet has a substantially circular shape.

8. A fluid conditioning nozzle comprising:

a first opening defining an inlet and having a cross-sectional centerline;

a second opening defining an outlet and having a shape that is symmetric about only one line of symmetry;

a transition surface extending between the inlet and the outlet and defining a passageway through the nozzle; wherein the transition surface has a transition center line and wherein the inlet cross-sectional centerline and the transition centerline do not coincide; and wherein the inlet, the outlet and the transition surface are cooperable to provide a first region outside the nozzle of positive pressure and a second region outside the nozzle of negative pressure, the first and second regions being substantially the same distance from the second opening.

9. A method of conditioning a flow of fluid, the method comprising:

(i) introducing a fluid into an nozzle body that has a first opening defining an inlet having a first cross-sectional centerline, a second opining defining an outlet and generally having the shape of a parallelogram with no right angles, and a transition surface extending between the inlet and the outlet to define a passageway through the nozzle wherein the transition surface has a transition center line and wherein the inlet cross-sectional centerline and the transition centerline do not coincide; and (ii) directing the fluid through the passageway and then through the outlet.

10. The method of claim 9, further comprising applying a pressure to the fluid to provide a first region outside the nozzle of positive pressure and a second region outside the nozzle of negative pressure, the first and second regions being substantially the same distance from the outlet.

11. The method of claim 9 wherein the transition surface is eccentric throughout a longitudinal dimension of the nozzle.

12. The method of claim 9 wherein the inlet has a substantially circular shape.

13. A method of conditioning a flow of fluid, the method comprising:

(i) introducing a fluid into a nozzle body that has a first opening defining an inlet having a first cross-sectional centerline, a second opening defining an outlet and having a shape that is symmetric about only one line of symmetry, and a transition surface extending between the inlet and the outlet to define a passageway through the nozzle wherein the transition surface has a transition center line and wherein the inlet cross-sectional centerline and the transition centerline do not coincide;

(ii) directing the fluid through the passageway and then through the outlet; and (iii) applying a pressure to the fluid to provide a first region outside the nozzle of positive pressure and a second region outside the nozzle of negative pressure, the first and second regions being substantially the same distance from the outlet.

* * * * *